US006769678B2

(12) United States Patent
Hobbs

(10) Patent No.: US 6,769,678 B2
(45) Date of Patent: Aug. 3, 2004

(54) SHEET SEPARATING DEVICE

(75) Inventor: John N. Hobbs, Hampton, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/998,528

(22) Filed: Nov. 28, 2001

(65) Prior Publication Data

US 2003/0098541 A1 May 29, 2003

(51) Int. Cl.[7] ..... B65H 5/08
(52) U.S. Cl. ..... 271/11; 271/100; 271/103; 271/104
(58) Field of Search ..... 271/11, 99, 100, 271/103, 104, 107, 277, 275

(56) References Cited

U.S. PATENT DOCUMENTS 3,100,110 A * 8/1963 Winkler et al.
4,358,100 A * 11/1982 Muller ..... 271/11
4,462,585 A * 7/1984 Gieson et al. ..... 271/11
5,664,786 A 9/1997 Buschhaus et al. ..... 271/10.09
5,833,229 A * 11/1998 Prim ..... 271/11
5,979,889 A * 11/1999 Klopfenstein ..... 271/11
6,070,866 A * 6/2000 Wepfer ..... 271/11 X
6,186,500 B1 * 2/2001 Eugster ..... 271/11 X
6,193,229 B1 2/2001 Hall et al. ..... 271/109

* cited by examiner

*Primary Examiner*—David H. Bollinger
(74) *Attorney, Agent, or Firm*—Davidson, Davidson & Kappel, LLC

(57) ABSTRACT

A device for separating a lowermost flat product from a stack of flat products including at least one sucker cup moveable so as to removably attach along a front edge portion of the lowermost flat product and to separate the lowermost flat product from a next adjacent flat product in the stack of flat products, and a gripper configured for gripping the lowermost flat product along a lateral edge and for transporting the lowermost flat product away from the stack of flat products. In addition, a method of separating a lowermost flat product from a stack of flat products, including removeably attaching at least one sucker cup along a front edge portion of the lowermost flat product, moving the at least one sucker cup so as to separate the lowermost flat product from a next adjacent flat product in the stack of flat products, gripping along a lateral edge portion of the lowermost flat product using a gripper, releasing the at least one sucker cup from the front edge of the lowermost flat product and transporting the lowermost flat product away from the stack of flat products using the gripper.

20 Claims, 2 Drawing Sheets

SHEET SEPARATING DEVICE

BACKGROUND OF THE INVENTION

1. Field of the Invention

The present invention relates generally to a device for separating a lowermost flat product from a stack of flat products, and particularly to a device having at least one sucker cup for removably attaching along a front edge portion of the lowermost flat product and separating the lowermost flat product from a next adjacent flat product in the stack of flat products.

2. Background Information

In the technology of building books, including booklets, magazines, periodicals, and the like, the use of collating systems is well known. These systems typically have a transporting device on which individual flat products, such as signatures or sheets, are gathered to build a book-block set, which then is finished and bound. Typically, a number of feeders are arranged along the transporting device, each of the hoppers comprising a feeding mechanism for feeding an individual flat product from a stack of flat products onto the transporting device, in order to gradually build up the book-block set or to insert a supplement sheet into a pocket of a pocket feeder or into a newspaper arranged in the pocket. Such feeding mechanisms typically employ a sheet-separating device for separating a sheet or other single flat product from a stack of flat products which is arranged in each hopper. The single flat products are typically drawn from the stack at its bottom end.

When the flat products are printed signatures or sheets having a fold, the flat products are typically transported into a hopper with the flat products arranged so that the folded edge of the flat product is the leading edge and the loose edges of the flat product is the trailing edge. After such folded products are fed onto the transporting device, they are preferably arranged with a lateral edge as the leading edge of the flat product before entering the collating device.

A sheet separating device is described, for example, in U.S. Pat. No. 5,664,786, which is herewith incorporated by reference herein. This document describes a rotating separator disk moveable between sheet material articles. A single suction applicator head, or sucker cup, is positioned underneath a front corner portion of a lowermost sheet of material in a stack of sheets. The single sucker cup disengages the corner portion of the lowermost sheet to enable a rotating separator disk to be inserted between the lowermost sheet and a next adjacent sheet in the stack. Grippers 68 and 70 on rotating drum 42 grip the leading edge portion of the lowermost sheet and pull the lowermost sheet from the hopper.

Another sheet separating device is described in U.S. Pat. No. 6,193,229 B1, which is herewith incorporated by reference herein. This document also describes a rotating separator disk moveable between sheet material articles. A single sucker arm having a sucker cup mounted thereon uses a vacuum to draw the leading edge portion of a lowermost signature in a stack of signatures. A separator disk enters to help separate the lowermost signature from the stack of signature. Grippers 26 arranged on a feed drum 16, grip the leading edge of the lowermost signature. Rotation on the drum transports the lowermost signature away from the stack of signature.

A disadvantage of both of these known devices, is that the lowermost sheet or signature is delivered by the grippers to the transporting device with the folded edge as the leading edge. When used together with a collating device, the signatures or folded sheets must enter the collating device with a lateral edge as the leading edge. Thus, an extra process step is involved in rotating the signatures or sheets before enter the collating device.

Another known sheet separating device includes a sucker bar including two sucker cups for attaching along the lateral edge of a lowermost flat product in a stack of flat products. Grippers, disposed on a rotating drum grip the lowermost flat product along the lateral edge and transport the lowermost flat product away from the stack of flat products and to a transporting device with the lateral edge being the leading edge. This device has the advantage that the flat products leaving the separating device are oriented in the correct position to enter the collating device. However, attaching the sucker cups to the lateral edge of the lowermost flat product, especially when the flat product is a folded sheet product or a signature, and/or when thin or poor quality paper is used. Pulling down on the lateral edge of the folded product can cause tearing of the lowermost sheet, or imperfect separation of the lowermost product. In the latter case, the feeding mechanism may jam, and the process must be paused until the jam has been cleared again.

SUMMARY OF THE INVENTION

The present invention provides a device for separating a lowermost flat product from a stack of flat products. The device includes at least one sucker cup moveable so as to removably attach along a front edge portion of the lowermost flat product and to separate the lowermost flat product from a next adjacent flat product in the stack of flat products and a gripper configured for gripping the lowermost flat product along a lateral edge and for transporting the lowermost flat product away from the stack of flat products.

The device may also include a separator element insertable in a space defined between the lowermost flat product and the next adjacent flat product. The flat products may be signatures and/or folded sheets. A hopper for receiving the flat products and for supporting the stack of flat products may also be included.

The at least one sucker cup may be connected to a sucker bar. In addition, the separator element may be rotatably mounted about a separator element axis. A drum disposed below the stack of flat products and rotatable about a drum axis parallel to the lowermost flat product may also be included. The gripper may be connected to a circumferential surface of the drum. The separator element may be disposed adjacent the front edge portion of the lowermost flat product.

The invention also comprises a method of separating a lowermost flat product from a stack of flat products. The method includes the steps of removeably attaching at least one sucker cup along a front edge portion of the lowermost flat product, moving the at least one sucker cup so as to separate the lowermost flat product from a next adjacent flat product in the stack of flat products, gripping along a lateral edge portion of the lowermost flat product using a gripper, releasing the at least one sucker cup from the front edge of the lowermost flat product and transporting the lowermost flat product away from the stack of flat products using the gripper.

The method may also include inserting a separator element into a space defined between the lowermost flat product and the next adjacent flat product. A hopper may be used for sequentially receiving the flat products and supporting the stack of flat products. The at least one sucker cup may be connected to a sucker bar, and the separator may be inserted from the front edge portion of the lowermost flat product, and may be inserted by rotating the separator element about a separator element axis.

The step of transporting the lowermost product maybe performed using a rotating a drum with the gripper being connected to a circumferential surface of the drum. The flat products may include signatures and/or folded sheets.

BRIEF DESCRIPTION OF THE DRAWINGS

The present invention is elaborated upon below with reference to the accompanying drawings, in which.

DETAILED DESCRIPTION

Figure 1:
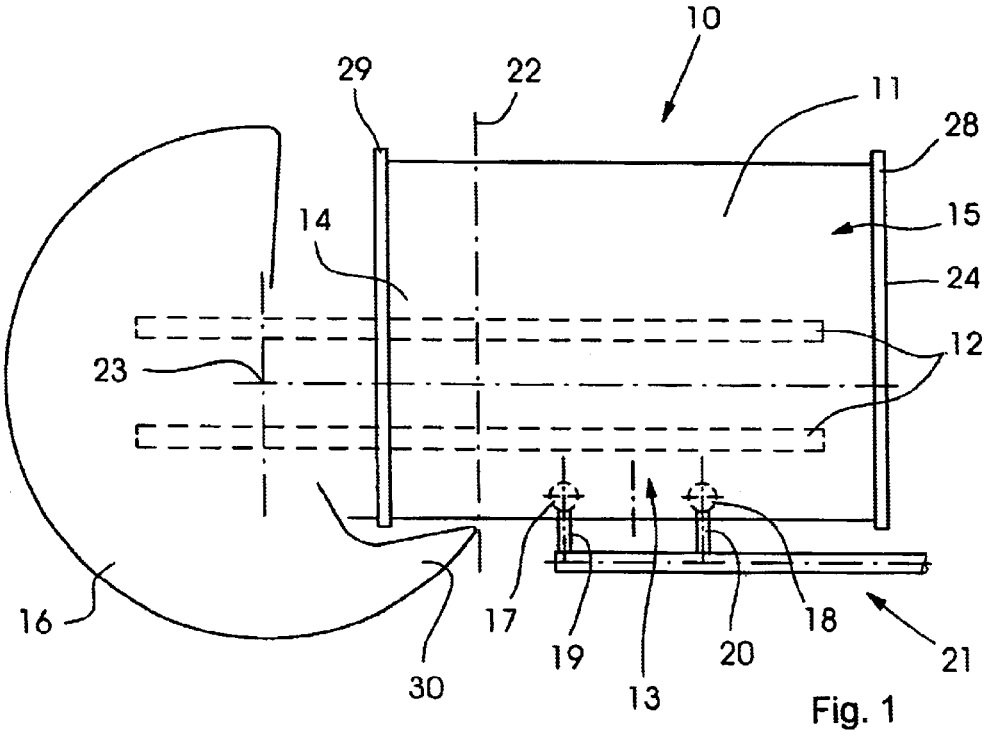
FIG. 1 shows a schematic top view of an device according to the present invention.

Referring to FIG. 1, device 10 includes a stack of flat products 11 which may be signatures. First and second sucker cups 17 and 18 are connected to sucker bar 21 via sucker cup connecting elements 19 and 20. A vacuum may be provided to sucker cups 17 and 18 through sucker bar 21. Hopper 24, which includes first lateral edge support portion 28 and second lateral edge support portion 29, supports the stack of flat products 11.

Hopper 24 receives the flat products in the stack of flat products 11 one at a time from a feeding mechanism (not shown) at a location adjacent the hopper at the top portion of FIG. 1. First lateral edge portion 14 of the stack of flat products 11 is supported by the first lateral edge support portion 29 of the hopper 24. Second lateral edge portion 15 of the stack of flat products 11 is supported by second lateral edge portion 28 of the hopper 24. Front edge portion 13 of the stack of flat products 13 is adjacent to the first lateral side edge portion 14 and the second lateral edge portion 15 and adjacent to sucker bar 21. Front edge portion 13 corresponds to the leading corresponds to the leading edge of each flat product as was received by hopper 24 from the feeding mechanism. If the flat products in the stack of flat products 11 are folded, the folded edge corresponds to front edge portion 13. Drum 12 rotates about drum axis 22, which is parallel to the plane of FIG. 1. Separator element 16, which includes insertable portion 30, rotates about separator element axis 23, which is perpendicular to the plane of FIG. 1, and is therefore shown in FIG. 1 as a point.

Figure 2:
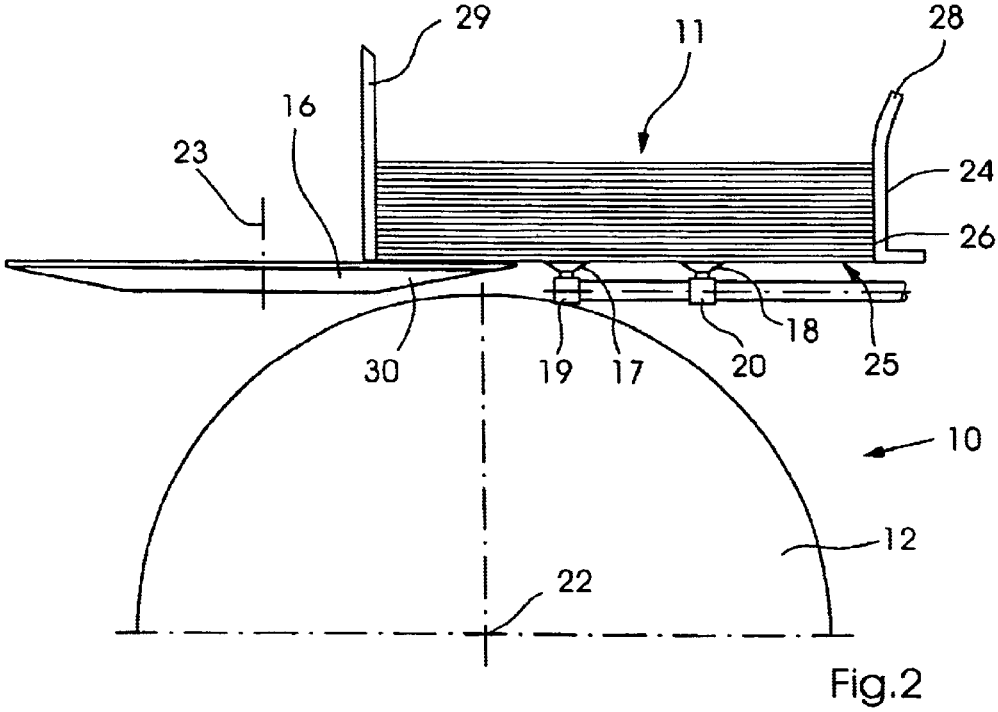
FIG. 2 shows a schematic side view of the device of FIG. 1 with sucker cups attached along a front portion of a lowermost flat product.

FIG. 2 shows a schematic side view of the device of FIG. 1. Sucker cups 17 and 18 are shown attached to lowermost flat product 25 at the front edge portion 13. Next adjacent flat product 26 is also visible in FIG. 2. As seen more clearly in FIG. 1, insertable portion 30 of separator element 16 is positioned adjacent to the front edge portion 13 of the stack of flat products 11.

Figure 3A:
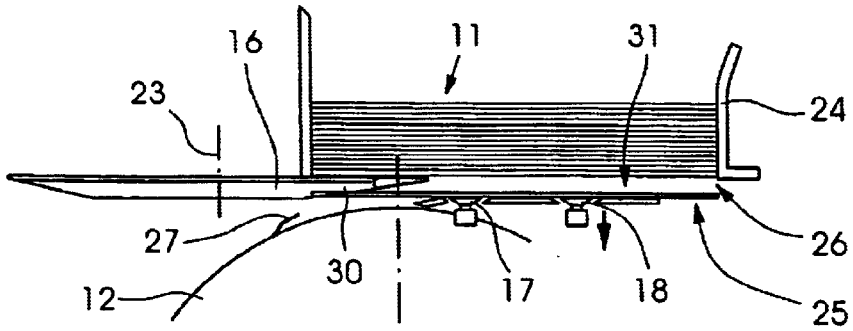
FIG. 3*a* shows a partial schematic side view the device of FIG. 1 with the lowermost flat product separated from a next adjacent flat product and a separator element inserted therebetween.

Referring to FIG. 3*a*, first and second sucker cups 17 and 18 are still attached to lowermost flat product 25 and have moved downward relative to their position in FIG. 2 so as to separate lowermost flat product 25 from the next adjacent flat product 26. In the mean time, the separator element 16 has rotated in a counterclockwise direction about its axis 23, so that the insertable portion 30 of the separator element 16 has been inserted into space 31 defined between the lowermost flat product 25 and the next adjacent flat product 26. Gripper 27 disposed on a circumference of drum 12, is positioned near to the first lateral edge portion 14 of lowermost flat product 25.

Figure 3B:
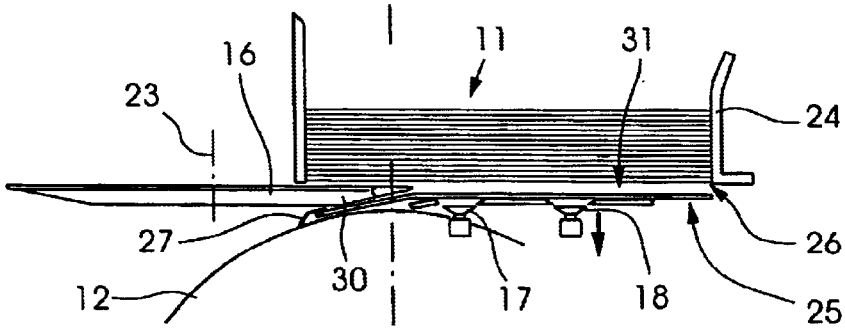
FIG. 3*b* shows a partial schematic side view of the device of FIG. 1 with a gripper positioned to grip a lateral portion of the lowermost flat product.

In FIG. 3*b*, separator element 16 is shown rotated further in a counterclockwise direction relative to its orientation in FIG. 3*a* so that its insertable portion 30 is penetrated more deeply into the space 31. In addition, the first and second suckers 17 and 18 are shown to have moved upwards relative to their positions shown in FIG. 3*a*., which causes the first lateral edge portion 14 of the lowermost flat product 25 to protrude slightly below separator element 16. Furthermore, drum 12 is shown rotated slightly in a clockwise direction relative to its orientation in FIG. 3*a* so that gripper 27 is able to grip the protruding first lateral edge portion 14 of lowermost flat product 25. Once the lowermost flat product 25 has been gripped by gripper 27, first and second sucker cups 17 and 18 release from front edge portion 13 of lowermost flat product 25—such as by releasing the vacuum inside the sucker cups—to allow the lowermost flat product 25 to be transported away from the hopper 24.

Figure 3C:
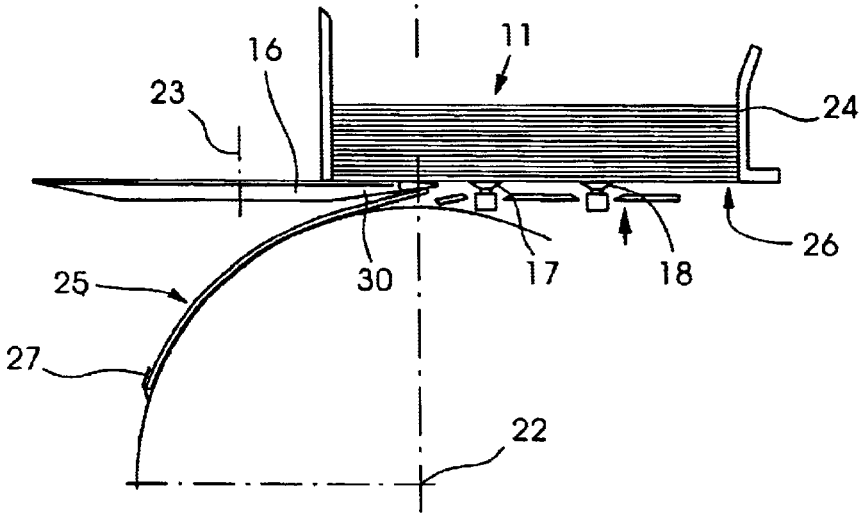
FIG. 3*c* shows a partial schematic side view of the device of FIG. 1 with the lowermost flat product removed from the stack along a drum and the sucker cups attached along a front edge portion of the next lowermost flat product.

In FIG. 3*c*, drum 12 is shown rotated in the counterclockwise direction relative to its orientation shown in FIG. 3*b*. Lowermost flat product has been gripped by gripper 27 at and transported on the circumference of drum 12 away from the hopper 24. First and second sucker cups 17 and 18 are shown attaching to front edge portion 13 of flat product 26, which has now become the lowermost flat product. Separator element 16 is shown in a position such that insertable portion 30 is shown positioned adjacent to the front edge portion 13 of the stack of flat products 11, as it was in FIGS. 1 and 2.

Figure 3D:
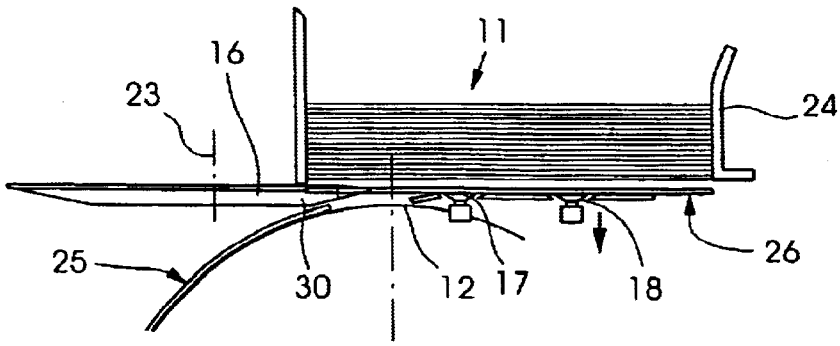
FIG. 3*d* shows partial schematic side view of the device of FIG. 1 with the next lowermost flat product separated from a next adjacent flat product and a separator element inserted therebetween.

FIG. 3*d* shows the cycle beginning again. First and second sucker cups 17 and 18 are shown still attached to lowermost flat product 25 and have moved downward relative to their position in FIG. 3*c* so as to separate flat product 26 from the next adjacent flat product to flat product 26. In the mean time, the separator element 16 has begun to rotate in a counterclockwise direction about its axis 23, so that the insertable portion 30 begins its insertion into the space defined between the flat product 26 and the next adjacent flat product.

It will of course be understood that the present invention has been described above only by way of example and that modifications of details can be made within the scope of the invention.

What is claimed is:

1. A device for separating a lowermost flat product from a stack of flat products, the device comprising:

at least one sucker cup moveable so as to removably attach along a front edge portion of the lowermost flat product and to separate the lowermost flat product from a next adjacent flat product in the stack of flat products;

a separator element insertable into a space defined between the lowermost flat product and the next adjacent flat product in the stack of flat products; and a gripper configured for gripping the lowermost flat product along a lateral edge and for transporting the lowermost flat product away from the stack of flat products, the gripper gripping the lateral edge as the separator element positions the lowermost flat product.

2. The device as recited in claim 1 wherein the separator element is insertable between front edges of the lowermost flat product and the next adjacent flat product, the gripper movable parallel to the front edges.

3. The device as recited in claim 1 wherein the flat products include at least one of signatures and folded sheets.

4. The device as recited in claim 1 further comprising a hopper for receiving the flat products and for supporting the stack of flat products.

5. The device as recited in claim 1 further comprising a sucker bar and wherein the at least one sucker cup is connected to the sucker bar.

6. The device as recited in claim 1 wherein the separator element is rotatably mounted about a separator element axis.

7. The device as recited in claim 6 wherein the separator element axis is normal to a plane of the lowermost flat product.

8. The device as recited in claim 1 further comprising a drum disposed below the stack of flat products and rotatable about a drum axis parallel to the lateral edge of the lowermost flat product and wherein the gripper is connected to a circumferential surface of the drum.

9. The device as recited in claim 1 wherein the separator element is disposed adjacent the front edge portion of the lowermost flat product.

10. The device as recited in claim 1 wherein the at least one sucker cup includes two sucker cups defining a line therebetween, the line and a front edge of the next adjacent flat product being parallel.

11. A method of separating a lowermost flat product from a stack of flat products, the method comprising:

removeably attaching at least one sucker cup along a front edge portion of the lowermost flat product;

moving the at least one sucker cup so as to separate the lowermost flat product from a next adjacent flat product in the stack of flat products;

inserting a separator element into a space defined between the lowermost flat product and the next adjacent flat product;

gripping along a lateral edge portion of the lowermost flat product while the separator element positions the lowermost flat product using a gripper;

releasing the at least one sucker cup from the front edge portion of the lowermost flat product; and transporting the lowermost flat product away from the stack of flat products using the gripper.

12. The method as recited in claim 11 wherein the inserting step includes inserting the separator element between front edges of the lowermost flat product and the next adjacent flat product so as to move the lateral edge of the lowermost flat product downwardly.

13. The method as recited in claim 11 further comprising sequentially receiving the flat products in a hopper and supporting the stack of flat products in the hopper.

14. The method as recited in claim 11 wherein the at least one sucker cup is connected to a sucker bar.

15. The method as recited in claim 11 wherein the step of inserting the separator element includes inserting the separator element from the front edge portion of the lowermost flat product.

16. The method as recited in claim 11 further wherein the inserting of the separator element is performed by rotating the separator element about a separator element axis.

17. The method as recited in claim 11 wherein the transporting the lowermost product is performed using a rotating a drum, the gripper being connected to a circumferential surface of the drum.

18. The method as recited in claim 11 wherein the flat products include at least one of signatures and folded sheets.

19. The method as recited in claim 11 wherein front edges of the flat products are a folded edge.

20. A device for separating a lowermost flat product from a stack of flat products, the lowermost flat product having a front edge and a lateral edge at a ninety degree angle to the front edge, the device comprising:

at least one sucker cup for connecting at the front edge to separate the lowermost flat product from a next adjacent flat product in the stack of flat products;

a separator element insertable into a space defined between front edge of the lowermost flat product and the next adjacent flat product in the stack of flat products so as to space the lateral edge of the flat product away from the next adjacent flat product; and a gripper drum having at least one gripper configured for gripping the lowermost flat product along the lateral edge as the separator element spaces the lateral edge of the flat product and for transporting the lowermost flat product away from the stack of flat products, the gripper drum having a rotational axis parallel to the lateral edge.

* * * * *